US009687954B2

(12) United States Patent
Maeda et al.

(10) Patent No.: US 9,687,954 B2
(45) Date of Patent: Jun. 27, 2017

(54) CENTRIFUGAL BARREL POLISHING DEVICE AND BARREL POLISHING METHOD

(71) Applicant: SINTOKOGIO, LTD., Nagoya-shi, Aichi (JP)

(72) Inventors: Kazuyoshi Maeda, Ama-gun (JP); Norihito Shibuya, Ama-gun (JP)

(73) Assignee: Sintokogio, Ltd., Nagoya-shi, Aichi (JP)

( * ) Notice: Subject to any disclaimer, the term of this patent is extended or adjusted under 35 U.S.C. 154(b) by 0 days.

(21) Appl. No.: 14/769,837

(22) PCT Filed: Oct. 31, 2013

(86) PCT No.: PCT/JP2013/079588

§ 371 (c)(1),
(2) Date: Aug. 24, 2015

(87) PCT Pub. No.: WO2014/129022

PCT Pub. Date: Aug. 28, 2014

(65) Prior Publication Data

US 2016/0016278 A1 Jan. 21, 2016

(30) Foreign Application Priority Data

Feb. 25, 2013 (JP) ..... 2013-034345
Aug. 26, 2013 (JP) ..... 2013-174078

(51) Int. Cl.
*B24B 31/02* (2006.01)
*B24B 31/023* (2006.01)
*B24B 31/033* (2006.01)

(52) U.S. Cl.
CPC ..... *B24B 31/0218* (2013.01); *B24B 31/023* (2013.01); *B24B 31/033* (2013.01)

(58) Field of Classification Search
CPC .. B24B 31/0218; B24B 31/023; B24B 31/033
(Continued)

(56) References Cited

U.S. PATENT DOCUMENTS 3,823,512 A * 7/1974 Kobayashi ..... B24B 31/0218 241/171
4,257,198 A * 3/1981 Balz ..... B24B 31/0218 451/32

(Continued)

FOREIGN PATENT DOCUMENTS

CN 85103080 10/1986
CN 1226191 8/1999

(Continued)

OTHER PUBLICATIONS

English-language translation of International Preliminary Report on Patentability (IPRP) dated Sep. 3, 2015 that issued in WO Patent Application No. PCT/JP2013/079588.

*Primary Examiner* — George Nguyen
(74) *Attorney, Agent, or Firm* — Drinker Biddle & Reath LLP

(57) ABSTRACT

A centrifugal barrel includes a disc-like turret configured to turn about a revolution shaft, a plurality of barrel tanks each installed in the turret via a rotation shaft and configured to turn about the rotation shaft, a rotating mechanism configured to turn the turret and the barrel tanks, and a tilting mechanism configured to tilt the revolution shaft of the turret with respect to a horizontal plane and to tilt each rotation shaft with respect to the horizontal plane. By tilting each rotation shaft with respect to the horizontal plane, it is possible to prevent the workpieces from being damaged.

16 Claims, 9 Drawing Sheets

(58) Field of Classification Search
USPC ..... 451/326–330
See application file for complete search history.

(56) References Cited

U.S. PATENT DOCUMENTS

| | | | | | |
|---|---|---|---|---|---|
| 4,308,693 | A * | 1/1982 | Harper | B24B 31/0218 | 451/329 |
| 4,505,072 | A * | 3/1985 | Kobayashi | B24B 31/02 | 241/171 |
| 5,189,842 | A * | 3/1993 | Kobayashi | B24B 31/12 | 451/326 |
| 5,348,637 | A * | 9/1994 | Kobayashi | C25D 17/26 | 204/213 |
| 6,758,729 | B2 * | 7/2004 | Fujishiro | B24B 31/033 | 451/104 |
| 2011/0256808 | A1 * | 10/2011 | Ma | B24B 31/0218 | 451/32 |

FOREIGN PATENT DOCUMENTS

| | | |
|---|---|---|
| CN | 102218697 | 10/2011 |
| CN | 102574265 | 7/2012 |
| JP | S61-095870 | 5/1986 |
| JP | H5-016130 | 3/1993 |
| JP | 2003-191161 | 7/2003 |
| JP | 2007-030167 | 2/2007 |
| JP | 2010-005712 | 1/2010 |

* cited by examiner (B)

(A)

(B)

CENTRIFUGAL BARREL POLISHING DEVICE AND BARREL POLISHING METHOD

TECHNICAL FIELD

One aspect and one embodiment of the present invention relate to a centrifugal barrel polishing machine and a barrel polishing method. The machine and the method can reduce damage occurring on surfaces of workpieces when components (workpieces) are polished. The components (workpieces) are composed of a hard brittle material, a metal, a synthetic resin, or a composite material.

BACKGROUND ART

A centrifugal barrel polishing machine for workpiece machining (barrel polishing) such as deburring, rounding, burnishing, polishing, surface roughness adjustment, or the like is known (for example, see Patent Literature 1). The workpiece machining is performed by putting an object (workpieces) to be polished and a polishing medium into a barrel tank and fluidizing the workpieces and the polishing medium in the barrel tank. The centrifugal barrel polishing machine fluidizes the workpieces and the polishing medium to polish the workpieces by rotating and revolving the barrel tank into which the workpieces and the polishing medium are put (like a sun-and-planet motion).

CITATION LIST

Patent Literature

Patent Literature 1: Japanese Utility Model Laid-open No. 05-016130

SUMMARY OF INVENTION

Technical Problem

Since workpieces are polished by rotation and revolution of the barrel tank, the centrifugal barrel polishing machine has high polishing capability. However, when workpieces composed of a hard brittle material which is hard but vulnerable to impact and fragile are polished, damage such as cracks or chipping occurs in corners or edges thereof.

Hard brittle materials are widely used as materials of various electronic components such as multi-layered ceramic capacitors (MLCCs), inductors, quartz oscillators, or the like. In electronic components, improvement in performance and a decrease in size are desired. Therefore, a polishing machine and a polishing method in which cracks and chipping are not generated in workpieces during polishing are desired.

When metal materials, synthetic resins, or various composite materials (for example, fiber-reinforced plastics such as carbon fiber-reinforced plastic (CFRP) or the like) are polished with a centrifugal barrel polishing machine, damage such as dents formed on the surfaces of workpieces, deformation of the workpieces, or scratches formed on the surfaces of the workpieces occurs due to collision between the workpieces or collision of the workpieces with the polishing medium.

For example, if the workpieces are damaged as described above when barrel polishing is performed on sliding portions of metal components such as engine components or rotating shafts, slidability thereof becomes poor. Since the fiber-reinforced plastics are being used more and more for components of aircrafts or automobiles, there is a problem in reliability of final products due to the above-mentioned damage by the barrel polishing.

In this technical field, there is a demand for a centrifugal barrel polishing machine and a barrel polishing method that can reduce occurrence of damage such as cracks, chipping, dents, deformation, and scratches in workpieces when the workpieces composed of hard brittle materials, metals, synthetic resins, or composite materials are polished.

Solution to Problem

According to an aspect of the present invention, there is provided a centrifugal barrel polishing machine that polishes workpieces by rotating and revolving a barrel tank. The barrel tank contains a mass including the workpieces and a polishing medium. The centrifugal barrel polishing machine includes: a disc-like turret configured to turn about a revolution shaft; a plurality of barrel tanks each installed in the turret via a rotation shaft and configured to turn about the rotation shaft; a rotating mechanism configured to turn the turret and the barrel tanks; and a tilting mechanism configured to tilt the revolution shaft of the turret with respect to a horizontal plane and to tilt each rotation shaft with respect to the horizontal plane. A principal reason for occurrence of damage to workpieces is that, when the centrifugal force in a barrel tank and the gravitational force of workpieces reach an equilibrium state, the mass is separated from the inner wall of the barrel tank and is scattered in the barrel tank and then the mass violently collides with the opposite inner wall. Using the tilting mechanism, the revolution shaft of the turret is tilted with respect to the horizontal plane and each rotation shaft is tilted with respect to the horizontal plane. Since each rotation shaft is tilted with respect to the horizontal plane, component forces act in addition to the gravitational force and the centrifugal force. Accordingly, even when the gravitational force and the centrifugal force reach an equilibrium state, the mass moves along the inner walls of each barrel tank due to the component forces. As a result, it is possible to prevent damage to workpieces due to collision of the workpieces with the inner walls of each barrel tank.

The tilting mechanism may include: a base to which the turret is fixed to be rotatable about the revolution shaft; a tilt trestle configured to tiltably fix the base; and a turning mechanism connected to the base and configured to freely tilt the base. Each barrel tank can be freely tilted by the turning mechanism. This tilting is performed by tilting each barrel tank in a range of 30° to 70° when the centrifugal force applied to the mass is present at least between a first centrifugal force and a second centrifugal force. This tilting includes both a case in which the barrel tanks are tilted at the same angle while performing the barrel polishing and a case in which the tilt angle of the barrel tanks is changed continuously or stepwise during the barrel polishing.

The turning mechanism may be a cylinder configured to freely tilt the base through extension and contraction of a piston. By adjusting the degree of extension and contraction of the piston of the cylinder, it is possible to freely adjust the tilt angle of the revolution shaft of the turret, that is, the tilt angle of each rotation shaft. Each rotation shaft may be tilted in a range of 30° to 70° with respect to the horizontal plane by the tilting mechanism.

The centrifugal barrel polishing machine may include a plurality of barrel tank cases to which the barrel tanks are respectively fixed, the rotation shafts may be respectively installed on one of the ends of the barrel tank cases, and each rotation shaft may be rotatably fixed to the turret. When the barrel tanks are tilted in a state in which two turrets are arranged to face each other, a large load is applied to the revolution shaft of the turrets and the rotation shafts. By employing the above-mentioned structure, even when the rotation shafts are tilted, the large load is not applied and it is thus possible to perform the barrel polishing well.

The tilting mechanism may fix the revolution shaft and the rotation shafts at a predetermined tilt angle and move the revolution shaft and the rotation shafts at an arbitrary angle. In the former case, an optimal tilt angle may be determined in advance and then a jig configured to tilt the revolution shaft and the rotation shafts to the tilt angle may be used. In the latter case, tilt angle adjusting means for freely adjusting the angle at which the barrel tanks are tilted may be further provided. The barrel tanks may be adjusted to an optimal tilt angle using the tilt angle adjusting means in consideration of attributes of workpieces, desired finishing precision, polishing time, or the like.

According to another aspect of the present invention, there is provided a barrel polishing method comprising: a step of rotating and revolving the barrel tanks; and a step of polishing the workpieces through the rotation and revolution of the barrel tanks, wherein the step of rotating and revolving the barrel tanks includes a step of continuously changing the angle formed by each rotation shaft and the horizontal plane. Here, "continuously changing" includes a case in which the tilt angle of the barrel tanks is continuously changed, a case in which the tilt angle of the barrel tanks is changed stepwise as will be described later, and a case in which the continuous changing and the stepwise changing are combined. In the case in which the tilt angle of the barrel tanks is changed stepwise and the case in which the continuous changing and the stepwise changing are combined, the damage to the workpieces can be further reduced particularly by appropriately selecting a tilting speed between a first centrifugal force and a second centrifugal force to be described later.

A barrel polishing method of changing the tilt angle of the barrel tanks stepwise in the centrifugal barrel polishing machine includes: a step of rotating and revolving the barrel tanks; and a step of polishing the workpieces through the rotation and revolution of the barrel tanks, wherein the step of rotating and revolving the barrel tanks includes a first tilting step of adjusting the tilt angle using the tilt angle adjusting means such that the barrel tanks are tilted at a first tilt angle while the centrifugal force applied to the mass reaches a second centrifugal force which is set as a centrifugal force at which the mass centrifugally comes in contact with the inner walls of each barrel tank after reaching a first centrifugal force which is set as a centrifugal force immediately before the mass is separated from inner walls of each barrel tank with its own weight and a step of adjusting the tilt angle using the tilt angle adjusting means such that the barrel tanks are tilted at a second tilt angle while the centrifugal force applied to the mass is maintained as a third centrifugal force which is set as a centrifugal force necessary for performing the barrel polishing after the first tilting step. When the centrifugal force of the barrel tanks and the gravitational force of the workpieces are in an equilibrium state, it is possible to prevent damage to the workpieces due to the collision of the workpieces with the inner walls of each barrel tank as described above by tilting the barrel tanks at the first tilt angle. Thereafter, by tilting the barrel tanks at the second tilt angle, it is possible to efficiently perform the barrel polishing. By providing these steps, it is possible to excellently perform the barrel polishing without causing damage to the workpieces and without causing unevenness in machining precision. The first tilt angle may range from 30° to 70° and the second tilt angle may range from 0° to 30°.

The centrifugal barrel polishing machine may further include rotation speed adjusting means for controlling a rotation speed of the rotation and revolution of the barrel tanks. A centrifugal barrel polishing method using the centrifugal barrel polishing machine having this configuration includes: a step of rotating and revolving the barrel tanks; and a step of polishing the workpieces through the rotation and revolution of the barrel tanks, wherein the step of rotating and revolving the barrel tanks includes a first acceleration step of adjusting the speed of the rotation and revolution of the barrel tanks using the rotation speed adjusting means such that the centrifugal force applied to the mass reaches a first centrifugal force, which is set as a centrifugal force immediately before the mass is separated from inner walls of each barrel tank with its own weight, within a first period of time and a second acceleration step of adjusting the speed of the rotation and revolution of the barrel tanks using the rotation speed adjusting means such that the centrifugal force applied to the mass reaches a second centrifugal force, which is set as a centrifugal force for centrifugally bringing the mass into contact with the inner walls of each barrel tank, within a second period of time after the first acceleration step. By providing the second acceleration step of rapidly accelerating the rotation and revolution of the barrel tanks such that the centrifugal force applied to the mass reaches the second centrifugal force which is set as a centrifugal force which is sufficiently greater than the gravitational force and at which the workpieces come in contact with the inner walls of each barrel tank after the first acceleration step of gradually increasing the speed of the rotation and revolution of the barrel tanks such that the centrifugal force in the barrel tanks reaches the first centrifugal force which is set in the vicinity of the gravitational force, it is possible to prevent scattering of the workpieces in each barrel tank. The first centrifugal force may range from 0.3 G to 1.0 G and the second centrifugal force may range from 1.5 G to 6.0 G.

The centrifugal barrel polishing machine may further include a preliminary rotation mechanism configured to only rotate each barrel tank. A barrel polishing method using the centrifugal barrel polishing machine having this configuration may be used to prevent cracks or chipping of workpieces when the workpieces formed of a hard brittle material are barrel-polished. The method may include: a preliminary polishing step of rounding angular portions of corners and edges of the workpieces by rotating each barrel tank through operation of the preliminary rotation mechanism; and a main polishing step of polishing the workpieces by rotating and revolving the barrel tanks after the preliminary polishing step. Generation of cracks and chipping in workpieces begins with angular portions of corners or edges. By rounding (performing R processing on) the angular portions in the initial polishing step, it is possible to reduce generation of cracks or chipping in the workpieces when performing the main polishing step. Here, the hard brittle materials are crystal materials such as various ceramics and quartz and materials having hard and brittle characteristics such as silicon and ferrite.

DESCRIPTION OF EMBODIMENTS

Figure 1:
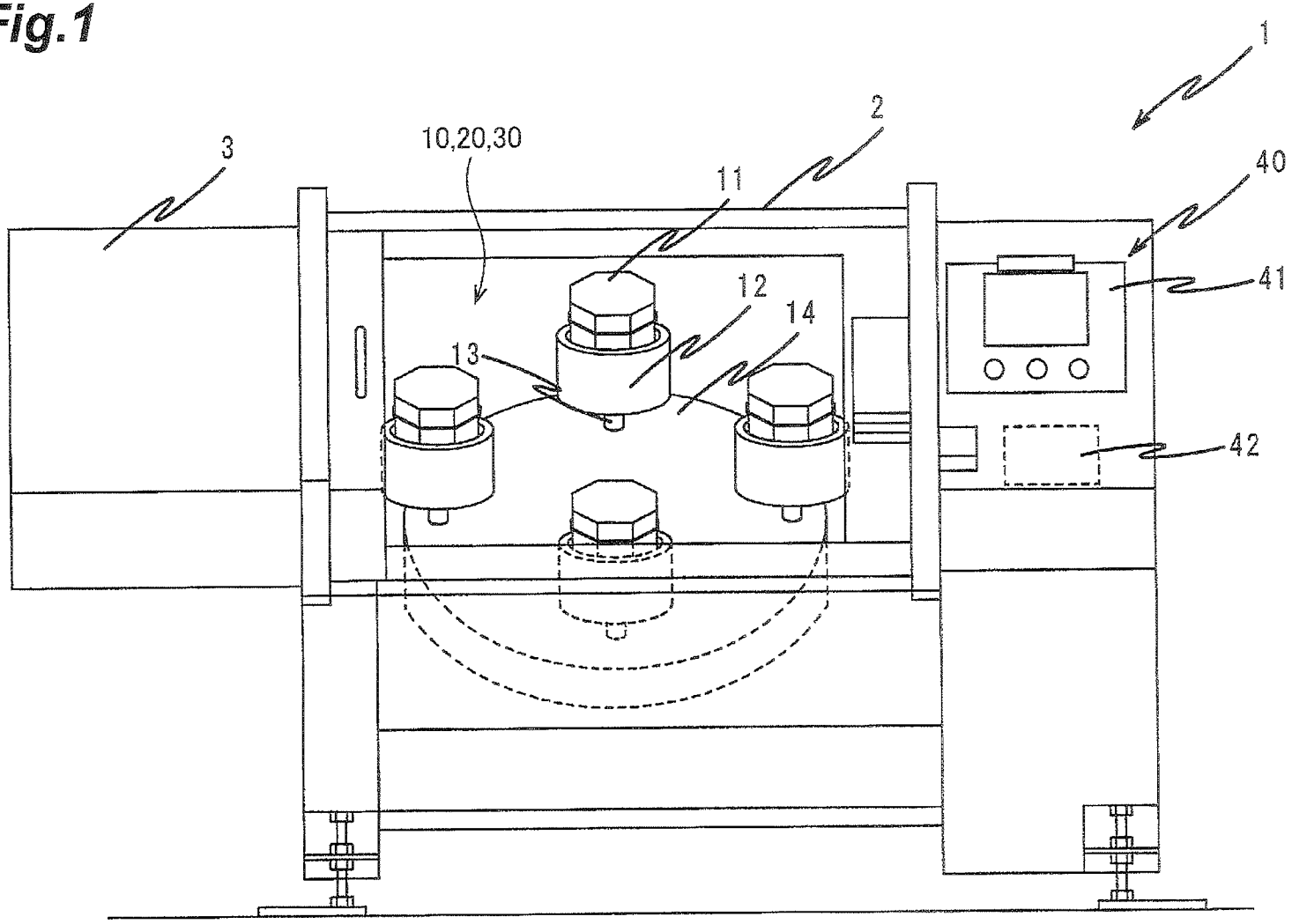
FIG. 1 is a schematic diagram illustrating a structure of a centrifugal barrel polishing machine according to a first embodiment.

An example of a centrifugal barrel polishing machine will be described below with reference to the drawings as embodiments. The present invention is not limited to the following embodiments. In the following description, right, left, up, and down refer to the directions shown in the drawings unless particularly mentioned otherwise.

First Embodiment

Figure 2:
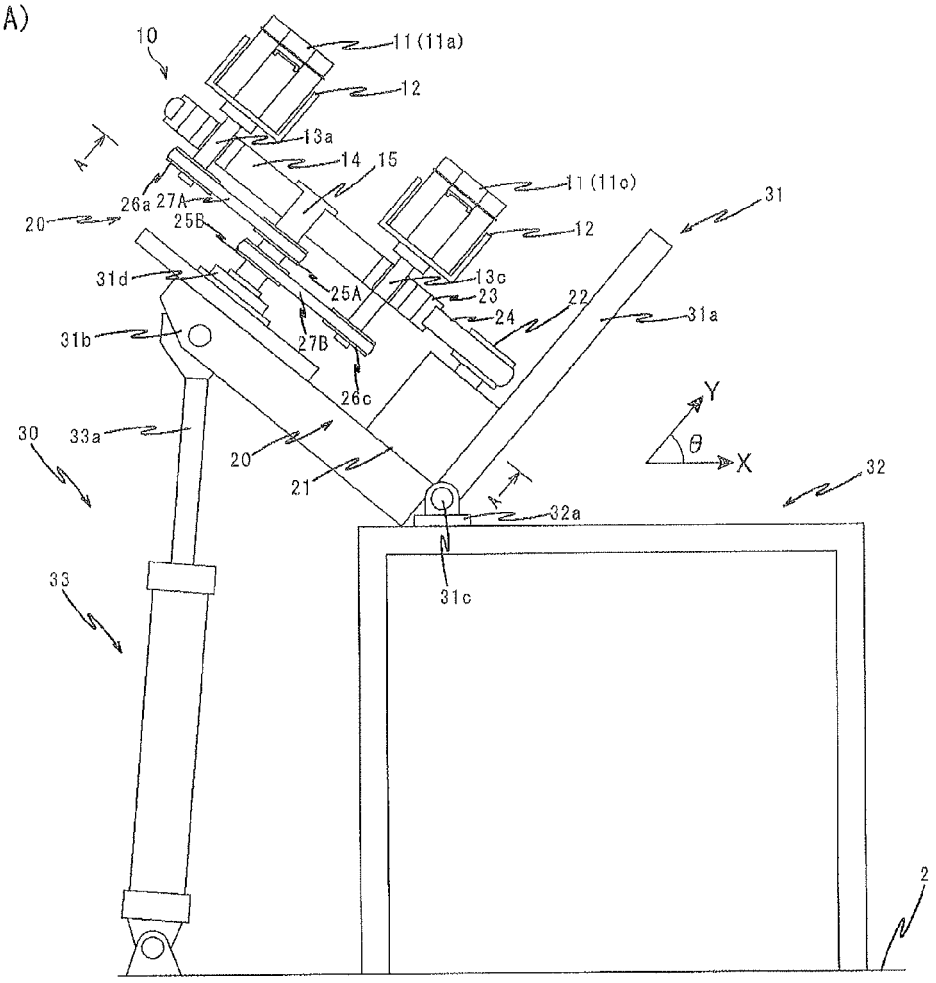
FIG. 2 is a schematic diagram illustrating the centrifugal barrel polishing machine according to the first embodiment, in which (A) of FIG. 2 is a schematic diagram illustrating principal parts of the centrifugal barrel polishing machine and (B) of FIG. 2 is a schematic diagram when viewed in an A-A direction of (A) of FIG. 2.
Figure 2:
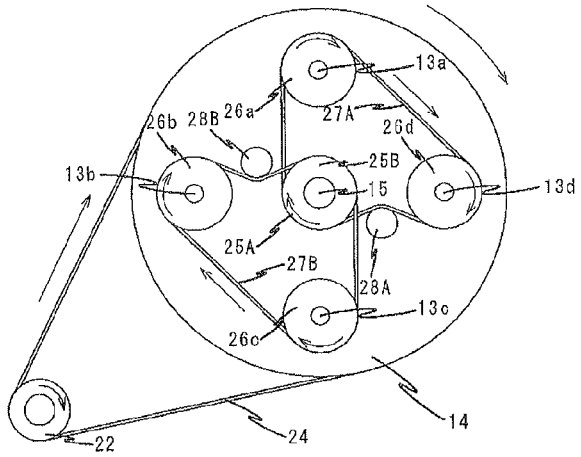

An example of a centrifugal barrel polishing machine will be described with reference to the drawings. FIGS. 1 and 2 are schematic diagrams illustrating a structure of a centrifugal barrel polishing machine according to a first embodiment. FIG. 1 illustrates an outline figure of the machine, (A) of FIG. 2 is a lateral view of the machine, and (B) of FIG. 2 is a schematic diagram in the A-A direction of (A) of FIG. 2. As illustrated in FIGS. 1 and 2, the centrifugal barrel polishing machine 1 includes a housing 2, a polishing unit 10, a rotating mechanism 20, a tilting mechanism 30, and a control mechanism 40. As illustrated in FIG. 1, the polishing unit 10, the rotating mechanism 20, and the tilting mechanism 30 are accommodated in the housing 2. The housing 2 is provided with a sliding door 3. FIG. 1 illustrates a state in which the sliding door 3 is opened.

The polishing unit 10 is disposed in the housing 2. The polishing unit 10 includes a plurality of barrel tanks 11, a plurality of barrel tank cases 12 to which the barrel tanks 11 are detachably fixed, and a turret 14 (rotary disc) to which the barrel tank cases 12 are rotatably fixed.

Each barrel tank 11 includes a box-like body of which a part is opened and a 11*d* covering the opening. In this embodiment, for example, each barrel tank 11 includes a body of which a top surface is opened and a 11*d* which is detachably fixed to cover the opening. The shape of the internal space (the cross-sectional shape perpendicular to the shaft center of each barrel tank 11) of each barrel tank 11 is octagonal. However, the shape of the internal space of each barrel tank 11 is not limited to the octagon. For example, the internal space may have a circular shape or another polygonal shape. When the internal space has a polygonal shape, fluidity of a mass under barrel polishing is improved.

Each barrel tank 11 is fixed to each barrel tank case 12. Each barrel tank case 12 has a rotation shaft 13 on the end thereof. Each barrel tank case 12 is fixed to the turret 14 via the rotation shaft 13. That is, each barrel tank 11 is rotatably installed in the turret 14 via each rotation shaft.

The turret 14 has a disc shape, and bearings into which the rotation shafts 13 are inserted are arranged at regular intervals in the circumferential direction. That is, the barrel tank cases 12 are fixed to the turret 14 at regular intervals in the circumferential direction. A revolution shaft 15 is vertically suspended from the center of the turret 14. Here, the positions (shaft directions) of the revolution shaft 15 and the rotation shafts 13*a* to 13*d* are relatively fixed. In the example illustrated in the drawings, the direction of the revolution shaft 15 and the directions of the rotation shafts 13*a* to 13*d* are fixed to be the same direction.

In this embodiment, for example, four barrel tanks 11 are used. In the following description, for convenience's sake, it is assumed that the barrel tanks 11 and the rotation shafts 13 are arranged in the order of the barrel tanks 11*a* to 11*d* and the rotation shafts 13*a* to 13*d* in the counterclockwise direction from the upper side in (B) of FIG. 2.

The rotating mechanism 20 includes a drive motor 21, a driving pulley 22, a revolution pulley 23, a driving belt 24, driven pulleys 25A and 25B, rotation pulleys 26*a* to 26*d*, driven belts 27A and 27B, and tightening pulleys 28A and 28B.

The rotating shaft of the drive motor 21 is disposed to be perpendicular to the main surface of the turret 14. The driving pulley 22 is fixed to the rotating shaft of the drive motor 21. The revolution pulley 23 is disposed on the outer circumference of the turret 14. The driving belt 24 is suspended over the driving pulley 22 and the revolution pulley 23. When the drive motor 21 is activated, the rotational force of the drive motor 21 is transmitted to the turret 14 via the driving pulley 22, the revolution pulley 23, and the driving belt 24. Accordingly, the turret 14 rotates about the revolution shaft 15. That is, the barrel tanks 11*a* to 11*d* turn (revolve) about the revolution shaft.

As illustrated in (A) of FIG. 2, two driven pulleys 25A and 25B each is fixed to the revolution shaft 15. The driven pulleys 25A and 25B have the same diameter. The rotation pulleys 26*a* to 26*d* each has the same diameter as the driven pulleys 25A and 25B and is fixed to the rotation shafts 13*a* to 13*d*. The driven belt 27A is suspended over the driven pulley 25A and the rotation pulleys 26*a* and 26*d*. The driven belt 27B is suspended over the driven pulley 25B and the rotation pulleys 26*b* and 26*c*.

The tightening pulleys 28A and 28B are contacted by the outer circumferential surface of the driven belts 27A and 27B, respectively, and serve to reduce slack in the belts. When the turret 14 rotates with the activation of the drive motor 21, the rotational force of the drive motor 21 is transmitted to the rotation pulleys 26*a* to 26*d* via the driven pulleys 25A and 25B and the driven belts 27A and 27B. Since the driven pulleys 25A and 25B and the rotation pulleys 26*a* to 26*d* have the same diameters, each of the rotation shafts 13*a* to 13*d* synchronously turns (rotates) at the same rotation speed as the revolution shaft 15, that is, the turret 14.

As described above, the revolution in which the barrel tanks 11*a* to 11*d* turn about the revolution shaft 15 and the rotation in which the barrel tanks 11*a* to 11*d* each turns about the rotation shafts 13*a* to 13*d* are synchronously performed by the rotating mechanism 20.

Immediately after the barrel tank 11 starts the rotation and revolution, the mass comes into contact with the inner wall of the lower part due to its own weight. When the barrel tank 11 rotates and revolves at a speed (steady speed) suitable for performing the barrel polishing, the mass comes into contact with the inner wall of the barrel tank 11 due to the centrifugal force. However, until the barrel tank is accelerated to a steady speed after the rotation and revolution start, there is a speed zone in which the gravitational force and the centrifugal force reach an equilibrium state. When the gravitational force and the centrifugal force approach the equilibrium state, the mass is separated from the inner wall of the barrel tank 11 and the mass violently collides with the opposite inner wall of the barrel tank 11. As a result, the workpieces violently collide with the inner wall of the barrel tank 11, the polishing medium violently collides with the workpieces, or the workpieces violently collide with each other. The inventors of the present invention found that this is one reason for damage to the workpieces. Therefore, the centrifugal barrel polishing machine 1 according to this embodiment is provided with a mechanism (tilting mechanism 30) that tilts the rotation shafts of each barrel tank 11 from a horizontal plane by relatively fixing the revolution shaft 15 and the rotation shafts of each barrel tank 11 and tilting the revolution shaft 15 from the horizontal plane and that can perform the barrel polishing in this state.

In a centrifugal barrel polishing machine according to the related art, the rotation shaft is arranged not to be tilted with respect to the drawing (horizontal plane). In this embodiment, the tilting mechanism 30 for tilting the rotation shafts of each barrel tank case 12 to which the barrel tanks 11*a* to 11*d* each is fixed with respect to the drawing when the barrel polishing is performed is provided. Using the tilting mechanism 30, the turret 14 is tilted at a predetermined angle as illustrated in FIG. 2 and the rotation shafts of each barrel tank case 12 to which the barrel tanks 11*a* to 11*d* each is fixed are tilted. By tilting the rotation shafts of each barrel tank case 12 to which the barrel tanks 11*a* to 11*d* each is fixed, component forces are generated in addition to the gravitational force and the centrifugal force. When the gravitational force and the centrifugal force reach an equilibrium state, the mass moves along the inner walls of each barrel tank 11 due to the component forces. That is, since the mass is not separated from the inner walls of each barrel tank 11, it is possible to prevent occurrence of damage in the workpieces due to violent collision of the mass with the opposite inner walls of each barrel tank 11.

An angle θ at which the rotation shafts of each barrel tank case 12 to which the barrel tanks 11*a* to 11*d* each is fixed is tilted by the tilting mechanism 30 is determined according to the horizontal axis X and the extension direction Y of the rotation shafts. The angle θ may be set to 30° or greater with respect to the drawing or may be set to 40° or greater with respect to the drawing. The angle θ may be set to 50° or less or may be set to 70° or less. That is, the angle θ may be set to a range of 30° to 70° or may be set to a range of 40° to 50°. When the tilt angle of the rotation shafts of each barrel tank case 12 to which the barrel tanks 11*a* to 11*d* each is fixed is less than 30°, a speed zone in which the mass is separated from the inner walls of each barrel tank 11 is generated as described above and the workpieces are damaged. When the tilt angle of the rotation shafts of each barrel tank case 12 to which the barrel tanks 11*a* to 11*d* each is fixed is greater than 70°, fluidity of the mass in each barrel tank 11 during the barrel polishing is poor and unevenness in finishing precision is caused.

The tilt angle of the rotation shafts of each barrel tank case 12 to which the barrel tanks 11*a* to 11*d* each is fixed may be fixed to the same angle from start to end of the barrel polishing or the tilt angle may be changed with the progress of the barrel polishing.

The tilting mechanism 30 is configured to set the tilt angle to a predetermined angle depending on the type or shape of workpieces or the machining purpose. The tilting mechanism 30 in this embodiment includes a base 31 for fixing the polishing unit 10 and the rotating mechanism 20, a tilt trestle 32 for tiltably fixing the base 31, and a cylinder 33 including a stretchable shaft (piston) as a turning mechanism.

The base 31 includes a tiltable base 31*a* to which the drive motor 21 is fixed and a tilting member 31*b* that is vertically installed on the tiltable base 31*a*. A pivot shaft 31*c* is fixed to both side surfaces (the front surface and the back surface in (A) of FIG. 2) of the tiltable base 31*a*. A rotation shaft bearing 31*d* that rotatably axially supports the revolution shaft 15 is fixed to the tilting member 31*b*. The turret 14 is fixed to the tilting member 31*b* via the rotation shaft bearing 31*d*. In this way, the polishing unit 10 and the rotating mechanism 20 are fixed to the base 31.

The tilt trestle 32 is fixed in the housing 2. A pivot shaft bearing 32*a* that rotatably axially supports the pivot shaft 31*c* is fixed to the top surface of the tilt trestle 32. The base 31 is fixed to pivot about the pivot shaft 31*c* by the pivot shaft bearing 32*a*.

In the cylinder 33, a base located on the opposite side to the piston 33*a* is rotatably fixed to the bottom of the housing 2. The tip of the piston 33*a* is rotatably fixed to the tilting member 31*b*. When the cylinder 33 is activated to change an amount of stroke of the piston 33*a*, the base 31 pivots with the stroke of the piston 33*a*.

As described above, by activating the cylinder 33 to adjust the amount of stroke of the piston 33*a*, it is possible to tilt the barrel tanks 11 at a predetermined angle. As the cylinder 33 in this embodiment, for example, an electric servo cylinder is used to set the tilt angle of the barrel tanks 11 more accurately.

The turning mechanism is not limited to the above-mentioned configuration. As an automatic tilting configuration, for example, a motor for tilting a pulley and the base 31 may be installed and the motor and the base 31 may be connected via the pulley by a wire. In another example, the base may be manually tilted. For example, the turning mechanism may include a gear GA (not illustrated) fixed to the pivot shaft 31*c*, a gear GB (not illustrated) connected to the gear GA and rotatably fixed to the tilt trestle 32, a handle (not illustrated) fixed to the gear GB so as to turn the gear GB, and a rotation-preventing mechanism (not illustrated) for restricting the rotation of the gear GB. When the handle is manually turned, the gear GA and the gear GB rotate and the base 31 is tilted. At this time, since the gear GB does not rotate without a force for turning the handle by the rotation-preventing mechanism, the tilt angle of the base 31 can be manually arbitrarily set.

When it is not necessary to change the tilt angle of the barrel tanks 11 depending on the situation, a structure in which the base 31 is simply tilted and fixed at a predetermined angle with a jig or the like without using a mechanism for arbitrarily adjusting the tilt angle such as the cylinder 33 may be employed. In this case, the manufacturing cost of the centrifugal barrel polishing machine 1 decreases.

The barrel tanks 11 are tilted along with the rotation shaft 13. That is, the angle of the rotation shafts 13, to which each barrel tank 11 has been fixed, with respect to the revolution shaft 15 is constant regardless of the tilt angle of the barrel tanks 11. By employing this configuration, it is possible to rotate and revolve the barrel tanks 11 stably without depending on the tilt angle of the barrel tanks 11.

The control mechanism 40 includes an input unit 41 and a control unit 42. The input unit 41 includes a touch panel type operation panel and operation buttons and is connected to the control unit 42. The control unit 42 receives an instruction for the control unit 42 such as polishing conditions (such as a polishing time, a rotation speed of the drive motor, a time required for reaching a steady speed, a time required for stopping rotation from the steady speed, or the like) and outputs the instruction to the mechanisms. The input to the control unit 42 is input through the input unit 41. An operator can perform the input while checking the input on a monitor through the touch panel type operation panel.

Figure 3:
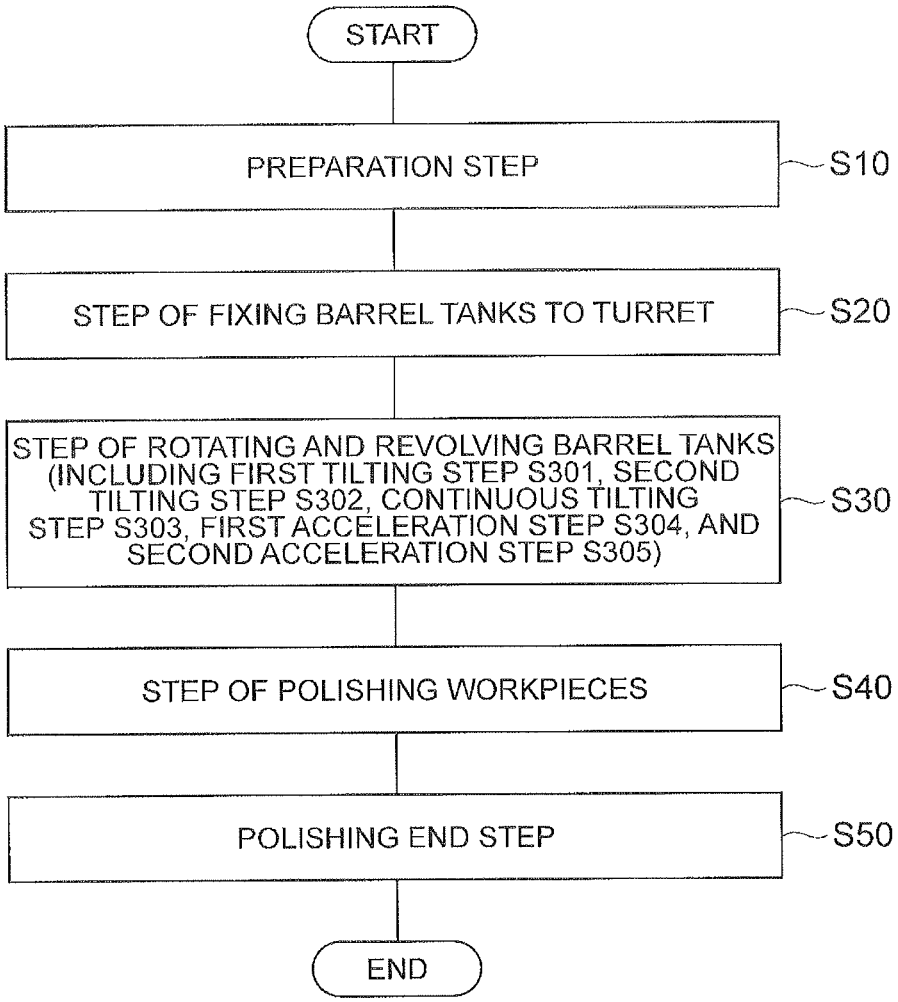
FIG. 3 is a flowchart illustrating a flow of operations of the centrifugal barrel polishing machine according to the first embodiment.

A barrel polishing method using the centrifugal barrel polishing machine 1 according to this embodiment will be described below with reference to FIG. 3. FIG. 3 is a flowchart illustrating a flow of operations of the barrel polishing method.

Step S10: Preparation Step

The input unit 41 disposed on the front side of the housing 2 receives operation information from an operator. The input unit 41 disposed on the front side of the housing 2 outputs preliminary polishing conditions to the control unit 42. The input polishing conditions in this embodiment include a "polishing time," a "rotation speed of the drive motor," a "tilt angle of the barrel tanks," and "acceleration time and deceleration time of the drive motor," but other conditions may be input if necessary.

S20: Step of Fixing Each Barrel Tank to Turret

Workpieces and a polishing medium are put into the bodies of four barrel tanks 11*a* to 11*d*. The workpieces are components formed of hard brittle materials, metals, synthetic resins, or composite materials. The hard brittle materials are materials having hard and brittle characteristics such as various ceramics, silicon, ferrite and crystal materials such as quartz. The polishing medium may be a medium including a resin containing abrasive grains, a medium including ceramics, a medium including ceramics and abrasive grains, a medium including a metal, a medium including glass, or a medium including plants, as long as it is generally used for barrel polishing and may be appropriately selected depending on the types or shapes of the workpieces, the purpose of the barrel polishing, or the like. The amount of workpieces and the polishing medium is not particularly limited, but is set to 10 vol % to 50 vol % with respect to the volume of the barrel tanks 11*a* to 11*d* in this embodiment. After the workpieces and the polishing medium are put into the barrel tanks 11*a* to 11*d*, the lids are fixed to the bodies to seal the bodies. Then, the sliding door 3 is opened and the barrel tanks 11*a* to 11*d* are fixed to four respective barrel tank cases 12. Since the turret 14 is maintained to be parallel to the drawing, the turret 14 can be manually rotated easily. The turret 14 is manually rotated and the four barrel tanks 11*a* to 11*d* are fixed to the four respective barrel tank cases 12. After the barrel tanks 11*a* to 11*d* are fixed to the turret 14 in this way, the sliding door 3 is closed.

S30: Step of Rotating and Revolving Barrel Tanks

When an operation button is turned on, the cylinder 33 is activated and the piston 33*a* extends by a length corresponding to a predetermined "tilt angle of the barrel tanks 11." Accordingly, the barrel tanks 11*a* to 11*d* perpendicular to the drawing are tilted at a predetermined angle. Subsequently, the drive motor 21 is activated. The rotational force of the drive motor 21 is transmitted to the turret 14 via the driving pulley 22, the revolution pulley 23, and the driving belt 24, and the turret 14 turns about the revolution shaft 15. Since the revolution shaft 15 and the driven pulleys 25A and 25B rotate with the turning of the turret 14, the barrel tank cases 12, that is, the barrel tanks 11*a* to 11*d*, rotate via the rotation pulleys 26*a* to 26*d* fixed to the rotation shafts 13*a* to 13*d* and the driven belts 27A and 27B. In this way, each of the barrel tanks 11*a* to 11*d* performs the revolution in which it turns in the circumferential direction of the turret 14 and the rotation in which it turns about one of the rotation shaft 13*a* to 13*d*.

The rotating mechanism 20 may be set to accelerate to a rotation speed optimal for the barrel polishing within a predetermined time by the control unit 42 so as to reduce its own load. In this acceleration process, the inside of the barrel tanks 11 sequentially enters states of "gravitational force applied to mass>centrifugal force applied to mass," "gravitational force applied to mass=centrifugal force applied to mass (equilibrium state)," and "gravitational force applied to mass<centrifugal force applied to mass" in this order. Hereinafter, the centrifugal force satisfying the state of "gravitational force applied to mass>centrifugal force applied to mass" is referred to as centrifugal force A, the centrifugal force in the equilibrium state is referred to as centrifugal force B, and the centrifugal force satisfying the state of "gravitational force applied to mass-centrifugal force applied to mass" is referred to as centrifugal force C.

Figure 7:
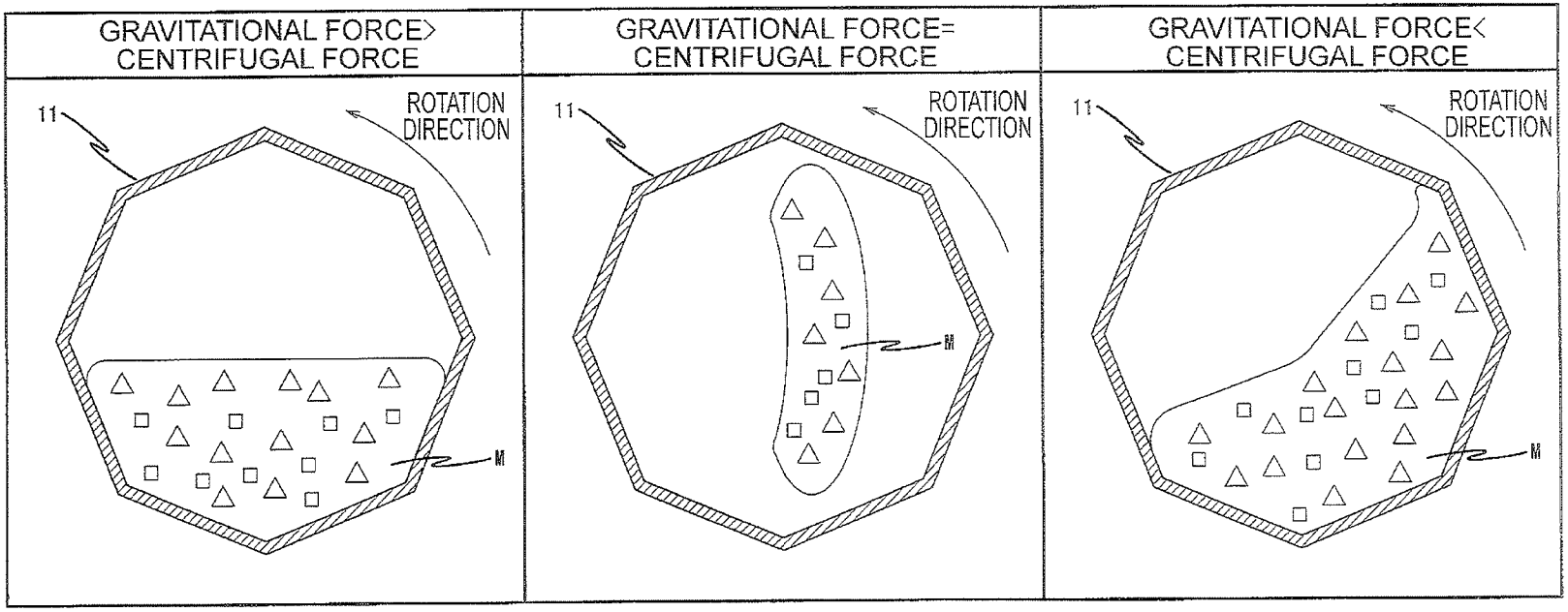
FIG. 7 is a schematic diagram illustrating behavior of a mass depending on a variation of a centrifugal force applied to a mass in the centrifugal barrel polishing machine.

FIG. 7 is a schematic diagram illustrating movements of a mass M in a barrel tank in a barrel polishing machine in the related art. FIG. 7 illustrates movements of the mass M in the equilibrium sate and before and after the equilibrium state. As illustrated in FIG. 7, when the centrifugal force applied to the mass M is the centrifugal force B, a phenomenon in which the mass M is separated from the wall of the barrel tank and is scattered in the barrel tank and then the mass M collides with the opposite inner wall occurs. On the other hand, in this embodiment, since the barrel tank 11 is tilted, component forces act on the mass M in addition to the gravitational force and the centrifugal force in the state of the centrifugal force B. Accordingly, the mass M moves along the inner wall of the barrel tank 11 due to the component forces. That is, since the mass M is not separated from the inner wall of barrel tank 11, the phenomenon in which the mass collides with the opposite inner wall as described does not occur. Therefore, the workpieces are not damaged.

Step S40: Step of Polishing Workpieces

The surfaces of the workpieces are polished by contact with the polishing medium, contact between the workpieces, and contact with the wall. The rotation and revolution of the barrel tanks 11 are continuously performed so as to maintain the state of the centrifugal force C for a predetermined time (the above-mentioned "polishing time"), whereby the barrel polishing is completed.

Step S50: Polishing End Step

After the barrel polishing is completed, the operation of the rotating mechanism 20 is stopped. At this time, in order to reduce a load to be applied to the rotating mechanism 20, deceleration may be set by the control unit 42 such that the rotation speed decreases within a predetermined time. In the deceleration process, the inside of each barrel tank 11 sequentially enters states of "gravitational force applied to mass≤centrifugal force applied to mass," "gravitational force applied to mass=centrifugal force applied to mass (equilibrium state)," and "gravitational force applied to mass-centrifugal force applied to mass" in this order. When the operation of the rotating mechanism 20 is stopped and the rotation and revolution of the barrel tanks 11 are stopped, the cylinder 33 is activated and the turret 14 becomes parallel to the drawing again. Thereafter, the sliding door 3 is opened and the barrel tanks 11*a* to 11*d* each is removed from the corresponding barrel tank cases 12. The lids of each of the barrel tanks 11*a* to 11*d* each is detached from the bodies, the contents thereof are taken out, and then the workpieces are selectively recovered from the contents.

A series of barrel polishing steps is completed through the above-mentioned steps.

In the above-mentioned steps, for the purpose of improvement in operability, the tilt angle of the turret 14 when the barrel tanks 11*a* to 11*d* each is fixed to the turret 14 is set to 0°, but the tilt angle of the turret 14 need not be changed unless there is a particular problem in operability.

In the above description, while the drive motor 21 is activated (that is, while the barrel tanks 11*a* to 11*d* each is rotating and revolving), the barrel tanks 11*a* to 11*d* each is tilted at a predetermined angle, but the tilt angles of each of the barrel tanks 11*a* to 11*d* may be changed depending on a variation of the centrifugal force applied to the mass. In the following description, the tilt angles of each of the barrel tanks 11*a* to 11*d* is changed depending on the rotation speed of the drive motor 21.

The centrifugal barrel polishing machine 1 may further include tilt angle adjusting means for adjusting the tilt angle of the barrel tanks 11. The configuration of the tilt angle adjusting means is not particularly limited, but the tilt angle of the barrel tanks 11*a* to 11*d* is adjusted using a servo cylinder and a controller in this embodiment. The controller is connected to the control unit 42 and the operation of the servo motor is controlled based on a signal from the control unit 42.

The tilt angle adjusting means is not limited to the above-mentioned configuration. Based on examples of the turning mechanism, when the base 31 and the motor in the turning mechanism are connected via the pulley by a wire, the tilt angle may be adjusted using a motor (for example, a servo motor) having a structure capable of adjusting a rotation angle and a controller controlling the motor. When the barrel tank is manually tilted, the tilt angle can be adjusted to an arbitrary angle using a rotation-preventing mechanism.

When the tilt angle adjusting means is further provided, a step of changing the tilt angle of the barrel tanks 11 depending on a variation in the centrifugal force applied to the mass may be provided as step S30. Specifically, a first tilting step and a second tilting step to be described below may be provided and this tilting pattern may be input to the control unit as a polishing condition.

(1) First Tilting Step (S301)

A step of tilting the barrel tanks 11 at the first tilt angle until the centrifugal force applied to the mass reaches a second centrifugal force which is set as a centrifugal force at which the mass centrifugally comes in contact with the inner walls of each barrel tank 11 after the centrifugal force applied to the mass reaches a first centrifugal force which is set as a centrifugal force immediately before the mass is separated from the inner walls of each barrel tank 11 with its own weight (2) Second Tilting Step (S302)

A step of tilting the barrel tanks 11 at the second tilt angle while the centrifugal force applied to the mass is maintained as the third centrifugal force which is set as a centrifugal force required for the barrel polishing after the first tilting step The workpieces are damaged when the centrifugal force applied to the mass is between the first centrifugal force and the second centrifugal force. According to experimental results, the inventors of the present invention found that when the tilt angle of the barrel tanks 11 is less, the polishing power for workpieces in the centrifugal barrel polishing machine is greater and the unevenness in polishing precision of the workpieces is less. Based on the above description, the first tilt angle is set to 30° or greater. The first tilt angle may be set to 40° or greater. The first tilt angle is set to 70° or less. The first tilt angle may be set to 50° or less. That is, the first tilt angle may be set to a range of 30° to 70° (or 40° to 50°). The second tilt angle is set to 0° or greater. The second tilt angle is set to 30° or less. That is, the second tilt angle may be set to a range of 0° to 30°. By adjusting the tilt angle of the barrel tanks 11 to the first tilt angle, the centrifugal force applied to the mass can be prevented from equilibrating with the gravitational force applied to the mass and it is thus possible to prevent damage to the workpieces. In addition, by adjusting the tilt angle of the barrel tanks 11 to the second tilt angle, it is possible to excellently polish the workpieces.

The first centrifugal force C1 is equal to or greater than 0.3 G. The first centrifugal force C1 is equal to or less than 1.0 G. Alternatively, the first centrifugal force C1 is equal to or less than 0.5 G That is, the first centrifugal force C1 may range from 0.3 G to 1.0 G or may range from 0.3 G to 0.5 G. When the centrifugal force applied to the mass is less than 0.3 G, the first centrifugal force becomes the centrifugal force A regardless of the attributes of the workpieces and the polishing medium. When the centrifugal force applied to the mass is greater than 1.0 G, the centrifugal force may become the centrifugal force B. The second centrifugal force C2 is equal to or greater than 1.5 G. The second centrifugal force C2 is equal to or less than 6.0 G. That is, the second centrifugal force C2 may range from 1.5 G to 6.0 G. When the centrifugal force applied to the mass is less than 1.5 G, the centrifugal force becomes the centrifugal force B regardless of the attributes of the workpieces and the workpieces are damaged. When the centrifugal force applied to the mass is greater than 6.0 G, the centrifugal force applied to the mass becomes excessive and the mass does not flow in the barrel tanks 11, making it difficult to excellently polish the workpieces.

The second centrifugal force C2 may be set to a centrifugal force at which the centrifugal force applied to the mass is greater than the gravitational force of the mass or may be set to a centrifugal force applied to the barrel tanks 11*a* to 11*d* which is optimal for the barrel polishing.

The first centrifugal force, the second centrifugal force, and the third centrifugal force are expressed by relative centrifugal acceleration of Expression 1, Symbols in Expression 1 are as follows.

RCF: relative centrifugal acceleration (G), r: rotation radius (m), g: gravitational acceleration (m/sec$^2$), N: revolution speed (min$^{-1}$)

$$RCF = \frac{r}{g}\left(\frac{N \times 2\pi}{60}\right)^2 \quad \text{[Expression 1]}$$

Similarly, step S50 may be provided with a step of adjusting the tilt angle of the barrel tanks 11 until the drive motor 21 stops.

This control can be performed based on the rotation speeds of the drive motor 21 corresponding to the first centrifugal force, the second centrifugal force, and the third centrifugal force.

When further reduction of damage to the workpieces is desired, step S30 may be provided with a step of changing the acceleration stepwise when the rotating mechanism 20 increases the rotation speed to a rotation speed optimal for the barrel polishing. That is, a step of changing the centrifugal force applied to the mass stepwise may be provided. This step will be described below. This step can be applied to both a case in which the tilt angle of the barrel tanks 11 is not changed and the case in which the tilt angle of the barrel tanks 11 is changed depending on a variation in the centrifugal force applied to the mass while the turret 14 is rotating.

An example in which the tilt angle is controlled stepwise is described above distinctly from the first tilting step S301 and the second tilting step S302, but a step (S303) of continuously changing the tilt angle using the tilt angle adjusting means may be provided. For example, the tilt angle adjusting means may continuously change the tilt angle of the barrel tanks 11 from 90° to 0°.

The centrifugal barrel polishing machine 1 may further include rotation speed adjusting means for adjusting the speed of the rotation and revolution of the barrel tanks 11*a* to 11*d*. The configuration of the rotation speed adjusting means is not particularly limited, but the speed of the rotation and revolution of the barrel tanks 11*a* to 11*d* is adjusted using an inverter capable of adjusting the rotation speed of the drive motor 21 in this embodiment. The inverter is connected to the control unit and the operation of the drive motor is controlled based on a signal from the control unit.

Step S30 may be further provided with a step of changing the speed of the rotation and revolution of the barrel tanks 11 depending on a variation in the centrifugal force applied to the mass. Specifically, a first acceleration step and a second acceleration step are provided as follows and this rotation pattern is input to the control unit as a polishing condition.

(1) First Acceleration Step (S304)

A first acceleration step of causing the centrifugal force applied to the mass to reach a first centrifugal force C1 which is set as a centrifugal force immediately before the mass is separated from the inner walls of each barrel tank 11 with its own weight within a predetermined time T1

(2) Second Acceleration Step (S305)

A second acceleration step of causing the centrifugal force applied to the mass to reach a second centrifugal force C2 which is set as a centrifugal force at which the mass centrifugally comes in contact with the inner walls of each of the barrel tanks 11*a* to 11*d* within a predetermined time T2

The workpieces are damaged when the centrifugal force applied to the mass is between the first centrifugal force and the second centrifugal force. By setting the time (predetermined time T2) therebetween to the shortest time in a range in which an excessive load is not applied to the drive motor 21, the time in which the centrifugal force applied to the mass is equilibrated with the gravitational force applied to the mass is shortened. As a result, since the time in which the mass is separated from the inner walls of each of the barrel tanks 11*a* to 11*d* is shortened, it is possible to prevent damage to the workpieces.

The first centrifugal force C1 may range from 0.3 G to 1.0 G or may range from 0.3 G to 0.5 G, as described above. The second centrifugal force C2 may range from 1.5 G to 6.0 G as described above.

Figure 4:
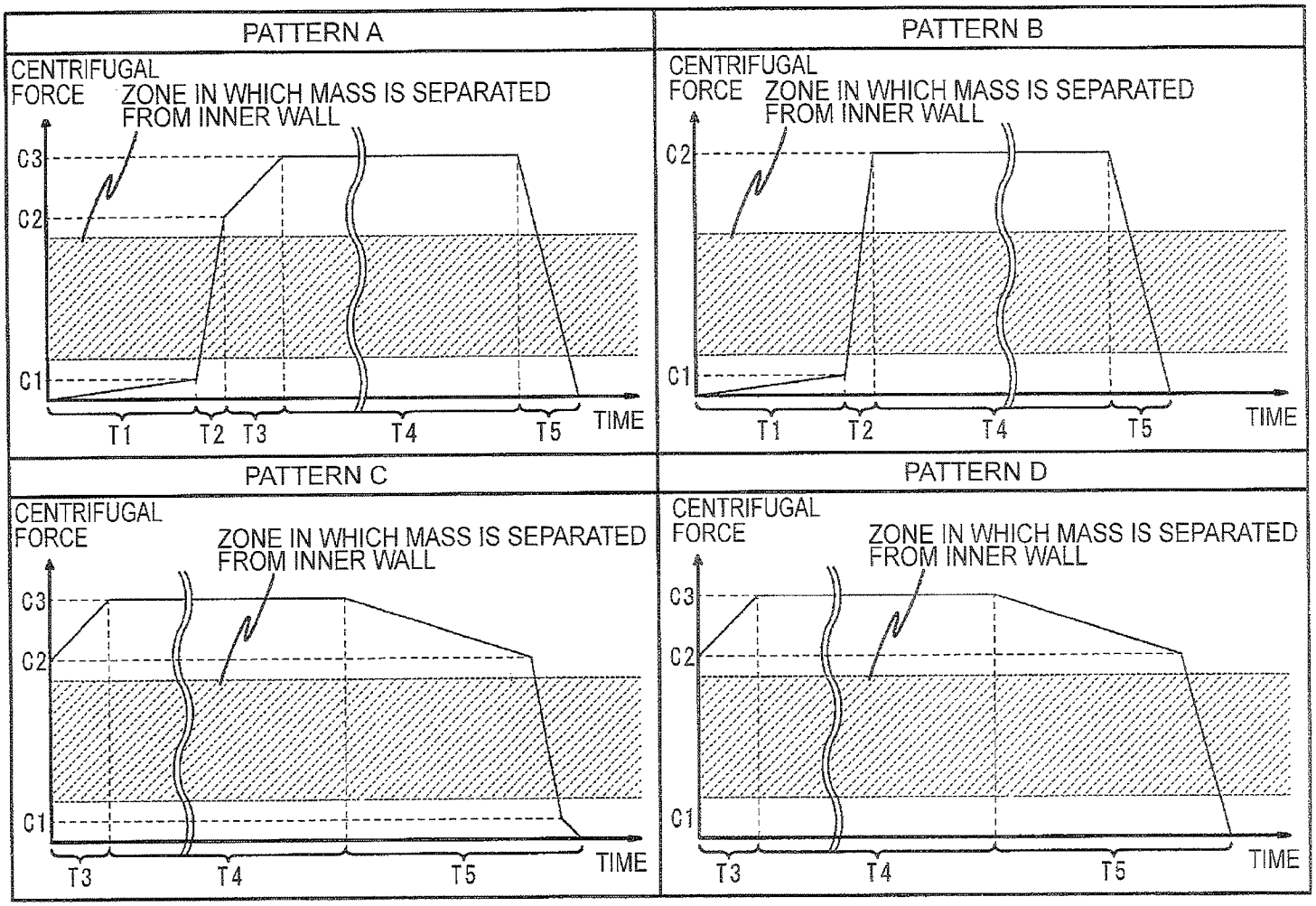
FIG. 4 is a graph illustrating an example of an operation pattern of a drive motor in the centrifugal barrel polishing machine according to the first embodiment.

The second centrifugal force C2 may be set to a centrifugal force at which the centrifugal force applied to the mass is greater than the gravitational force of the mass or may be set to a centrifugal force optimal for the barrel polishing. FIG. 4 is a graph illustrating examples of an operation pattern of the drive motor 21 in the centrifugal barrel polishing machine 1. When the centrifugal force applied to the mass is set to a centrifugal force greater than the gravitational force of the mass, a third acceleration step of operating the drive motor 21 such that the centrifugal force applied to the mass reaches a third centrifugal force C3 which is a centrifugal force required for the barrel polishing within a predetermined time T3 may be further provided as illustrated in pattern A of FIG. 4. When the centrifugal force applied to the mass is set to the centrifugal force optimal for the barrel polishing, the second centrifugal force C2 is equal to the third centrifugal force C3 and thus the third acceleration step is not necessary as illustrated in pattern B of FIG. 4.

Until the drive motor 21 stops within a predetermined time T5 after a polishing time T4 elapses, step S40 may be further provided with a step of similarly adjusting the tilt angle of the barrel tanks 11.

Step S50 may be provided with a step of similarly adjusting the rotation speed of the turret 14 until the drive motor 21 stops, as illustrated in pattern C and pattern D of FIG. 4. In pattern C, the rotation speed slowly decreases to the second centrifugal force C2, rapidly decreases to the first centrifugal force C1, and then slowly decreases and stops. In pattern D, the rotation speed slowly decreases to the second centrifugal force C2, rapidly decreases and stops.

Results of the barrel polishing on workpieces in the centrifugal barrel polishing machine according to this embodiment will be described below.

EXAMPLE 1

In Example 1, the "damage" and the "polishing precision" in dry and wet polishing were evaluated with respect to the tilt angle of a barrel tanks. Workpieces and polishing media to be described below were used. The conditions of test items are shown in Table 1.

<Workpieces>

A: Ceramics expressed by a chemical formula $Si_2O_3.Al_2O_3$ (2 mm×2 mm×4 mm)

B: Zirconia (2 mm×2 mm×4 mm)

<Polishing Media> a: ceramic sintered product (V-8, made by SINTOKOGIO, LTD.)

b: ceramic sintered product (V-10, made by SINTOKOGIO, LTD.)

c: Resin in which abrasive grains are dispersed (M1-F6T, made by SINTOKOGIO, LTD.)

d: Resin in which abrasive grains are dispersed (M1-F4T, made by SINTOKOGIO, LTD.)

TABLE 1

| | Test item | | | |
|---|---|---|---|---|
| | Damage | | Polishing precision | |
| Polishing method | Dry | Wet | Dry | Wet |
| Workpiece | A | B | A | A |
| Polishing medium | a | b | c | d |
| Polishing time (min) | 15 | 15 | 30 | 15 |

The workpieces and the polishing medium (and water in the case of the wet process) are put into the barrel tanks. The barrel tanks are tilted at a predetermined angle which is selected from a range of 0° to 90° and the barrel polishing machine is activated to perform the barrel polishing for a predetermined time.

The workpieces subjected to the barrel polishing are recovered, washed with water, and then evaluated. The evaluation method will be described below.

<Evaluation of Damage>

The damage was evaluated by measuring the volume of chipping or cracks. Damaged portions were observed using a laser microscope (VK-X200, made by KEYENCE Corporation) and the volume of the largest damaged portion was calculated. Five workpieces subjected to the barrel polishing under the same conditions were measured and the average value thereof was set as the volume of the damaged portion in the conditions.

<Evaluation of Polishing Precision>

To evaluate polishing precision, the shapes (R shapes) of the angular portions of four sides at the center in the length direction were measured using a stylus profilometer (SURFCOM 1500DX, made by TOKYO SEIMITSU CO., LTD.). Ten workpieces subjected to the barrel polishing under the same conditions were measured and the deviation (3σ/average) was calculated from the measurement results of a total of 20 points.

Figure 8:
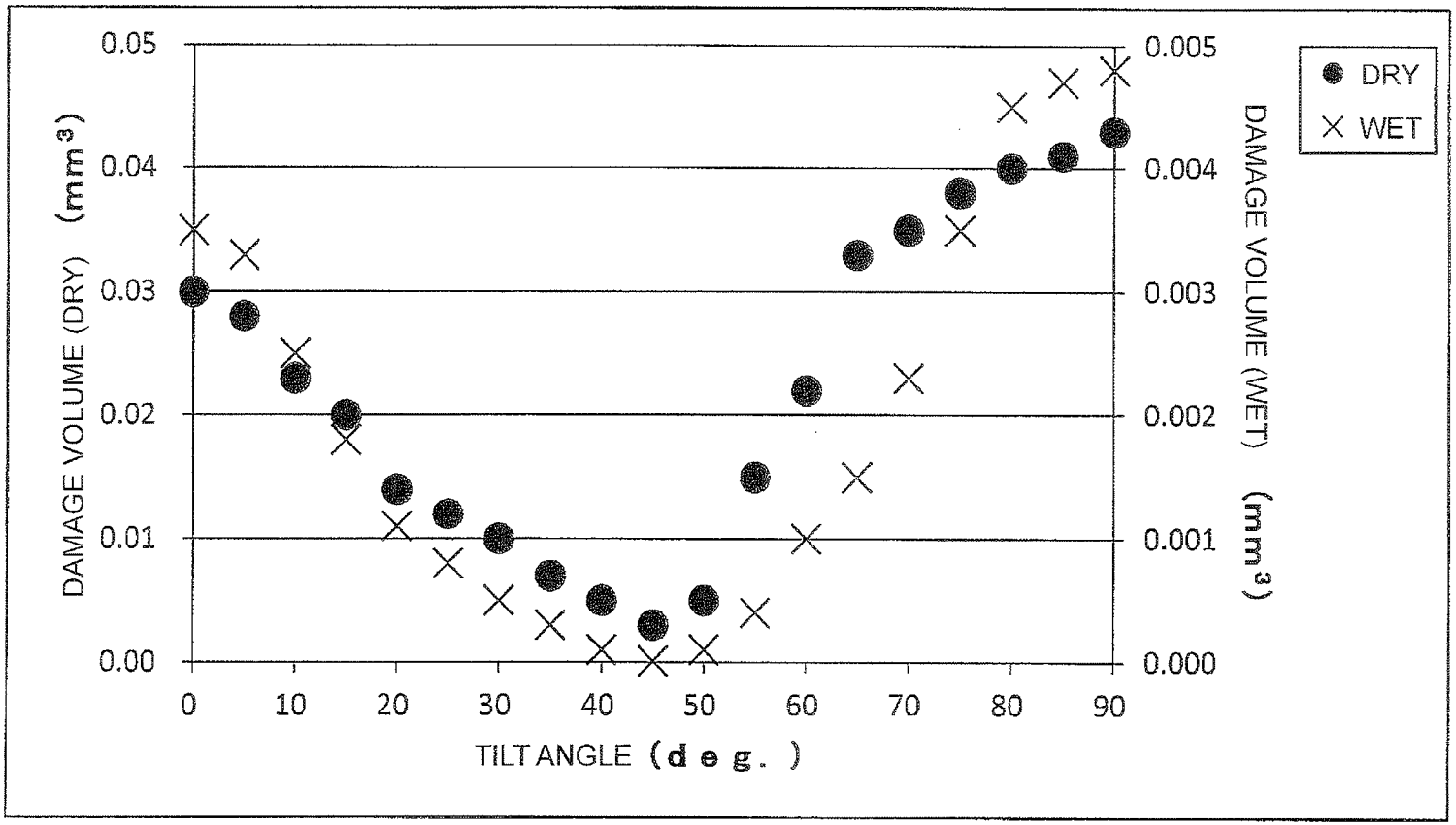
FIG. 8 is a graph illustrating a result of Example 1.

The evaluation results of damage are illustrated in FIG. 8. In both the dry process and the wet process, the volume of the damaged portion becomes smaller when the tilt angle is greater than 0°. A greater tilt angle results in a greater volume of the damaged portion from the vicinity of 45°.

Figure 9:
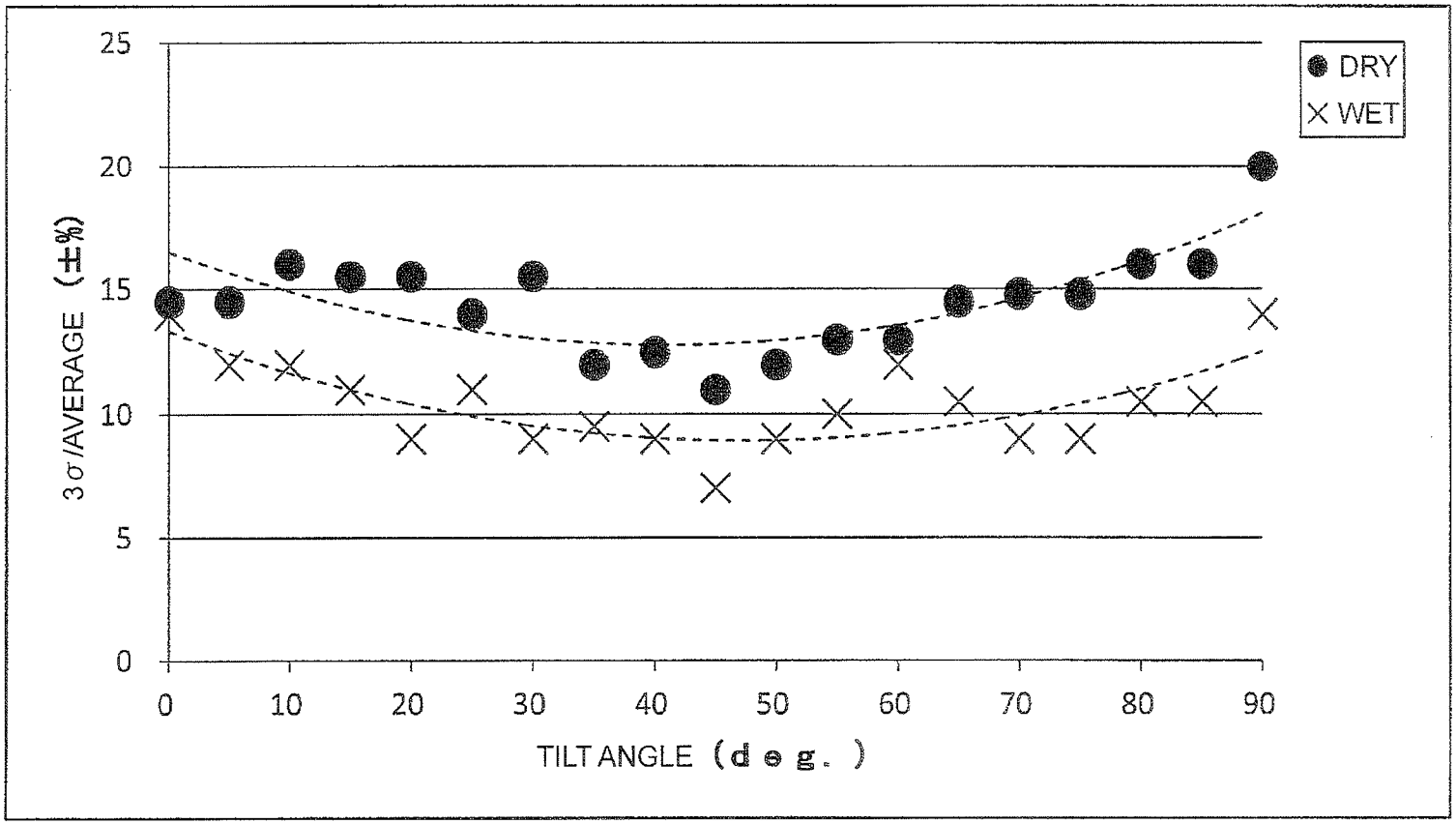
FIG. 9 is a graph illustrating a result of Example 1.

The evaluation results of polishing precision are illustrated in FIG. 9. When approximate lines calculated from the measurement results are used, in both the dry method and the wet method, the deviation becomes smaller when the tilt angle is greater than 0°. A greater tilt angle results in a greater deviation from the vicinity of 45°.

As a result, it could be seen that the damage of workpieces was reduced and the polishing precision was improved by tilting the barrel tanks. It could also be seen that workpieces could be barrel-polished more excellently by selecting the tilt angle of the barrel tanks depending on the attributes of the workpieces.

EXAMPLE 2

In Example 2, workpieces and polishing media shown in Example 1 and described below were used.

<Workpieces>

C: Barium titanate (2 mm×2 mm×2 mm)

D: Aluminum (2 mm×2 mm×2 mm)

E: CFRP (2 mm×2 mm×2 mm)

<Polishing Media> e: Ceramic burned product (PN-Bϕ10, made by SINTO KOGIO, LTD.)

f: Ceramic burned product (PN-A×10, made by SINTO KOGIO, LTD.)

g: Abrasive grains (AF60, made by SINTO KOGIO, LTD.)

Barrel polishing was performed under the conditions shown in Table 2 using the workpieces and the polishing media. In Table 2, "same as on the left" in the field of the second tilt angle means that the second tilt angle was equal to the first tilt angle, that is, the tilt angle was not changed depending on the rotation speed of the turret 14.

The workpieces subjected to the barrel polishing were washed with water, ten workpieces subjected to the barrel polishing under the conditions were selected, surface roughness Ra (JIS B6001: 1994) of the workpieces was measured using a surface roughness meter (SURFCOM 1500DX, made by TOKYO SEIMITSU CO., LTD.), and the "progress of polishing" and the "polishing precision" were evaluated. Through observation using a microscope (HX-2000, made by KEYENCE Corporation), the damage of the workpieces (cracks, chipping, dents, and scratches) was evaluated. The evaluation criteria will be described below.

<Progress of Polishing>

O: The ratio of the surface roughness (average) of the polished workpieces to the surface roughness (average) of the non-polished workpieces is improved to equal or greater than 40%.

X: The ratio of the surface roughness of the polished workpieces to the surface roughness of the non-polished workpieces is less than 40%.

<Polishing Precision>

O: The ratios of a maximum value and a minimum value of the surface roughness of the polished workpieces to the average are less than 10%.

Δ: The ratios of a maximum value and a minimum value of the surface roughness of the polished workpieces to the average range from 10% to 15%.

X: The ratios of a maximum value and a minimum value of the surface roughness of the polished workpieces to the average are greater than 15%.

<Cracks>

O: No crack is observed in any workpiece.

Δ: One to three workpieces having cracks are observed.

X: Four or more workpieces having cracks are observed.

<Chipping>

O: No chipping is observed in any workpiece.

Δ: One to five workpieces having chipping are observed.

X: More than six workpieces having chipping are observed.

<Dents>

O: No nick is observed in any workpieces.

Δ: One to three workpieces having dents are observed.

X: four or more workpieces having dents are observed.

<Scratches>

O: No scratch newly formed due to barrel polishing is observed.

Δ: No new scratch of 2 mm or greater due to barrel polishing is observed in any workpiece, and one to three workpieces having a scratch of less than 2 mm are observed.

X: A workpiece having a new scratch of 2 mm or greater due to barrel polishing is observed or more than three workpieces having a scratch of less than 2 mm are observed.

TABLE 2

| | Polishing conditions | | | | | Evaluation | | | | | |
|---|---|---|---|---|---|---|---|---|---|---|---|
| | | | Tilt angle [deg] | | | | | damage | | | |
| | Workpiece | Polishing medium | First tilt angle | Second tilt angle | Acceleration step | Progress of polishing | Polishing precision | chipping | crack | dent | scratch |
| Ex. 2-1 | C | c | 30 | Same as on the left | No | ○ | Δ | ○ | ○ | — | — |
| Ex. 2-2 | C | c | 40 | Same as on the left | No | ○ | ○ | ○ | ○ | — | — |

TABLE 2-continued

| | Polishing conditions | | | | | Evaluation | | | | | |
|---|---|---|---|---|---|---|---|---|---|---|---|
| | | | Tilt angle [deg] | | | | | damage | | | |
| | Workpiece | Polishing medium | First tilt angle | Second tilt angle | Acceleration step | Progress of polishing | Polishing precision | chipping | crack | dent | scratch |
| Ex. 2-3 | C | c | 50 | Same as on the left | No | ○ | ○ | ○ | ○ | | |
| Ex. 2-4 | C | c | 60 | Same as on the left | No | ○ | ○ | Δ | ○ | — | — |
| Ex. 2-5 | C | c | 70 | Same as on the left | No | ○ | ○ | Δ | ○ | — | — |
| Ex. 2-6 | C | c | 70 | Same as on the left | Yes | ○ | ○ | ○ | ○ | — | — |
| Ex. 2-7 | C | c | 30 | 0 | No | ○ | ○ | ○ | ○ | — | — |
| Ex. 2-8 | C | c | 30 | 20 | No | ○ | ○ | ○ | ○ | — | — |
| Ex. 2-9 | D | f | 30 | Same as on the left | No | ○ | Δ | — | — | Δ | Δ |
| Ex. 2-10 | D | f | 50 | Same as on the left | No | ○ | ○ | — | — | ○ | ○ |
| Ex. 2-11 | D | f | 70 | Same as on the left | No | ○ | ○ | — | — | Δ | Δ |
| Ex. 2-12 | D | f | 70 | Same as on the left | Yes | ○ | ○ | — | — | ○ | ○ |
| Ex. 2-13 | D | f | 30 | 0 | No | ○ | ○ | — | — | Δ | Δ |
| Ex. 2-14 | D | f | 30 | 20 | No | ○ | ○ | — | — | Δ | Δ |
| Ex. 2-15 | E | g | 30 | Same as on the left | No | ○ | Δ | ○ | ○ | Δ | Δ |
| Ex. 2-16 | E | g | 50 | Same as on the left | No | ○ | ○ | ○ | ○ | Δ | Δ |
| Ex. 2-17 | E | g | 70 | Same as on the left | No | ○ | ○ | Δ | ○ | Δ | Δ |
| Ex. 2-18 | E | g | 70 | Same as on the left | Yes | ○ | ○ | ○ | ○ | ○ | ○ |
| Ex. 2-19 | E | g | 30 | 0 | No | ○ | ○ | ○ | ○ | Δ | Δ |
| Ex. 2-20 | E | g | 30 | 20 | No | ○ | ○ | ○ | ○ | Δ | Δ |
| Com. Ex. 2-1 | C | c | 20 | Same as on the left | No | ○ | ○ | X | X | — | — |
| Com. Ex. 2-2 | C | c | 80 | Same as on the left | No | ○ | X | Δ | Δ | — | — |
| Com. Ex. 2-3 | D | f | 20 | Same as on the left | No | ○ | ○ | — | — | X | X |
| Com. Ex. 2-4 | D | f | 80 | Same as on the left | No | ○ | X | — | — | Δ | Δ |

In Examples 2-1 to 2-20, when the centrifugal force applied to the mass was at least between the first centrifugal force and the second centrifugal force, the barrel tanks 11 were tilted in the range of 30° to 70° and then the barrel polishing was performed. As a result, since the "progress of polishing" was evaluated to be O in all the examples, it can be seen that the workpieces were subjected to the barrel polishing.

The "polishing precision" was evaluated as O or Δ. It can be seen that the evaluation result of Δ is a level at which there is no problem in practice and is a level which is evaluated as O by optimizing other polishing conditions and thus good polishing precision is obtained by tilting the barrel tanks in the range of 30° to 70° and then performing the barrel polishing. When the tilt angle is 30° in the evaluation result of Δ (Examples 2-1, 2-9, and 2-15), the evaluation result was changed to O by providing the second tilting step with the second tilt angle set to 0° to 20° (Examples 2-7, 2-8, 2-13, 2-14, 2-19, and 2-20). As a result, it can be seen that the workpieces can be excellently polished by providing the second tilting step.

The damage of the workpieces was evaluated as O or Δ. When the tilt angle is set to 70° and the acceleration step is further provided, the evaluation results of chipping were improved from Δ to O (Examples 2-6, 2-12, and 2-18). It can be seen from this fact that there is no deviation in finishing precision of workpieces, the surfaces of the workpieces are not damaged, and the barrel polishing can be excellently performed in the conditions of Examples 2-1 to 2-20.

On the other hand, in Comparative Examples 2-1 to 2-4, when the centrifugal force applied to the mass is at least between the first centrifugal force and the second centrifugal force, the barrel tanks 11 were tilted to 20° or 80° and then the barrel polishing was performed thereon. As a result, when the tilt angle of the barrel tanks 11 was set to 20°, all the evaluation results of damage of workpieces were X and thus it can be seen that the workpieces were damaged (Comparative Example 2-1 and 2-3). When the tilt angle of the barrel tanks 11 is set to 80°, the evaluation results of "polishing precision" were X and thus it can be seen that a deviation in finishing precision occurred (Comparative Examples 2-2 and 2-4).

Second Embodiment

When workpieces are formed of a hard brittle material, generation of damage such as cracks or chipping begins with the angular portions of the workpieces. Accordingly, a mechanism (preliminary rotation mechanism 50) for causing only the barrel tanks 11 to rotate about the rotation shafts 13 in advance before rotating and revolving the barrel tanks 11 may be further provided. A centrifugal barrel polishing machine having the preliminary rotation mechanism will be described below as the second embodiment. In the following description, only differences from the first embodiment will be mentioned.

Figure 5:
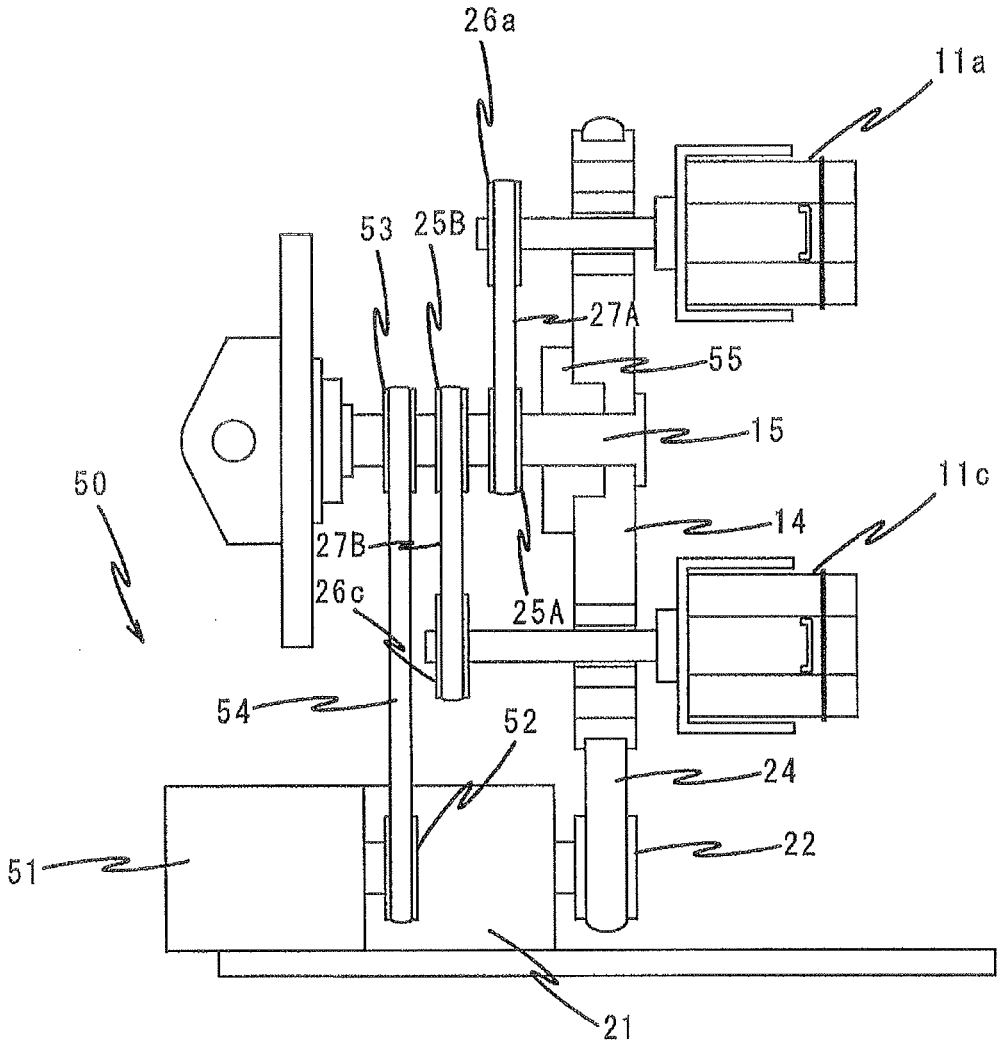
FIG. 5 is a schematic diagram illustrating a structure of a centrifugal barrel polishing machine according to a second embodiment.

The preliminary rotation mechanism 50 in this embodiment includes a preliminary drive motor 51, a preliminary driving pulley 52 disposed on the rotating shaft of the preliminary drive motor 51, a preliminary rotation pulley 53 fixed to the revolution shaft 15, a preliminary driving belt 54 suspended over the preliminary driving pulley 52 and the preliminary rotation pulley 53, and a clutch mechanism 55 fixed to the revolution shaft 15, as illustrated in FIG. 5.

The clutch mechanism 55 can freely connect the turret 14 and the revolution shaft 15. When the turret 14 and the revolution shaft 15 are disconnected from each other using the clutch mechanism 55, the rotational force of the drive motor 21 is not transmitted to the revolution shaft 15. When the preliminary drive motor 51 is activated in this state, the rotational force of the preliminary drive motor 51 is transmitted to the revolution shaft 15, and only the rotation shafts 13*a* to 13*d*, that is, the barrel tanks 11*a* to 11*d*, rotate via the driven pulleys 25A and 25B, the rotation pulleys 26*a* to 26*d*, and the driven belts 27A and 27B. In this way, the clutch mechanism 55 can switch the drive source of the revolution shaft 15 between the "drive motor" and the preliminary drive motor." That is, the motion of the barrel tanks 11 can be switched to the "rotation and revolution" or the "only rotation" using the clutch mechanism 55.

The configuration of the clutch mechanism 55 can be appropriately selected from mechanical configurations such as switching of a gear, configurations using electromagnetic force, or the like.

A barrel polishing method using the centrifugal barrel polishing machine having the preliminary rotation mechanism 50 mounted thereon will be described below. First, in step S10, preliminary polishing conditions are also input as the polishing conditions. The input preliminary polishing conditions in this embodiment include a "preliminary polishing time," a "rotation speed of the preliminary drive motor," and a "tilt angle of the barrel tanks in preliminary polishing," but other conditions may be input if necessary.

Subsequently, similarly to step S20 in the first embodiment, the barrel tanks 11*a* to 11*d* into which the mass has been put are fixed to the barrel tank cases 12 and then the sliding door 3 is closed.

When the operation button is turned on, the preliminary polishing step is performed. First, the cylinder 33 is activated and the piston 33*a* extends by a length corresponding to a predetermined "tilt angle of the barrel tanks." Accordingly, the barrel tanks 11*a* to 11*d* which are perpendicular to the drawing are tilted at a predetermined angle (50° in this embodiment). Subsequently, the drive source of the revolution shaft 15 is switched to the preliminary drive motor 51 by the clutch mechanism 55. Thereafter, the preliminary drive motor 51 is activated and the barrel tanks 11*a* to 11*d* rotate.

By continuously activating the preliminary drive motor 51 for a predetermined time (the "preliminary polishing time"), the angular portions of the workpieces are rounded (subjected to R processing) by the rotation using the preliminary drive motor 51. Since only the angular portions of the workpieces need be rounded, the rotation speed of the barrel tanks 11*a* to 11*d* may be set to be lower than the rotation speed when the barrel tanks 11*a* to 11*d* rotate and revolve in the subsequent step. The generation of damage in workpieces formed of a hard brittle material such as cracks or chipping begins with the angular portions of corners or edges of the workpieces. By rounding the angular portions of the workpieces, it is possible to prevent occurrence of "chipping" or "cracks" beginning with an angular portion when the workpieces are polished by rotating and revolving the barrel tanks 11*a* to 11*d* in the subsequent step.

After the preliminary polishing time elapses, the operation of the preliminary drive motor 51 is stopped. Then, the drive source of the revolution shaft 15 is switched to the drive motor 21 by the clutch mechanism 55 and the preliminary polishing step ends.

Thereafter, steps S30 to S50 in the first embodiment are performed in this order and the barrel polishing of the workpieces is completed.

This embodiment can be applied to all combinations of the "case in which the tilt angle of the barrel tanks is not changed while the turret is rotating," the "case in which a step of changing the tilt angle of the barrel tanks depending on a variation in the centrifugal force applied to the mass is provided," and the "case in which a step of changing the rotation speed of the turret depending on a variation in the centrifugal force applied to the mass."

Modification Example

In addition to the above-mentioned embodiments, a collision-preventing member may be disposed along the shaft center of each of the barrel tanks 11*a* to 11*d*. In an example of the collision-preventing member, as illustrated in (A) of FIG. 6, a cylindrical elastic member (such as gum, rubber, or the like) may be provided as the collision-preventing member 60. The mass M separated from the inner wall of barrel tank 11 collides with the collision-preventing member 60 and accordingly decreases in kinetic energy. As a result, since the kinetic energy is low when the mass M that has collided with the collision-preventing member 60 and returned collides with the inner wall, it is possible to prevent occurrence of damage in the workpieces.

The collision-preventing member 60 may be disposed to be rotatable about the shaft center of the barrel tank 11. Since the mass M collides with a collision-preventing member 30*a* which rotates relatively to the barrel tank 11, the angle at which the mass M having collided with the collision-preventing member 30*a* is returned is changed. Since the distance that the returned mass M moves to the inner wall of the barrel tank 11 increases, the kinetic energy decreases until the mass collides with the inner wall. As a result, it is possible to prevent occurrence of damage in the workpieces.

Figure 6:
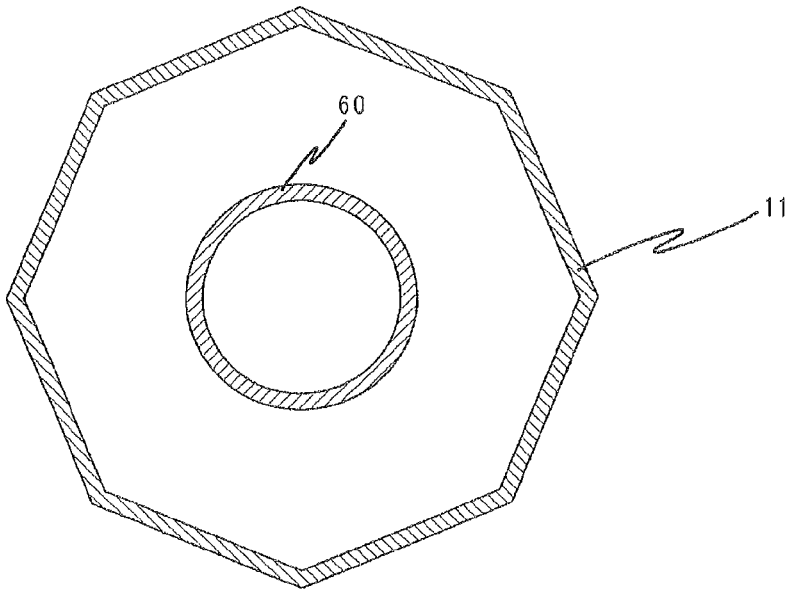
FIG. 6 is a diagram illustrating an example in which a collision-preventing member is disposed in a barrel tank as a modification example.
Figure 6:
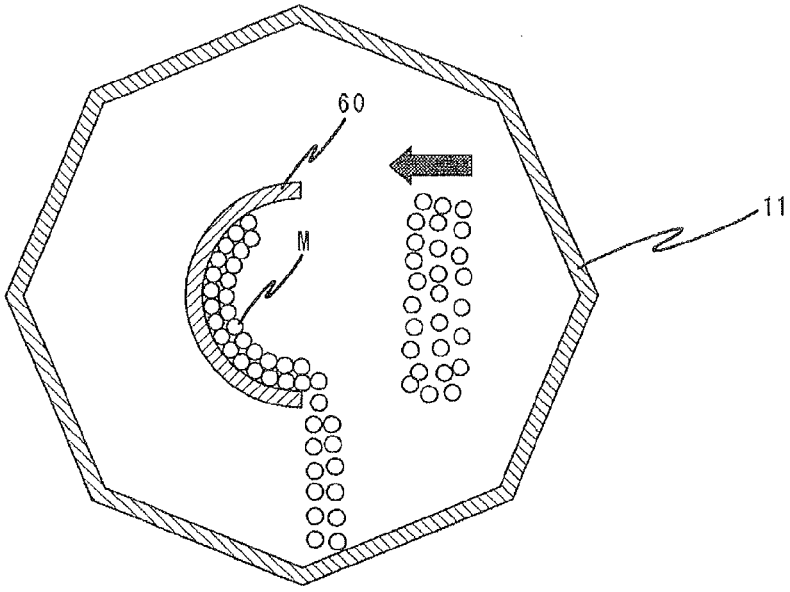

In another example of the collision-preventing member, an elastic member of which only a part forms a curved surface is used as the collision-preventing member 60 as illustrated in (B) of FIG. 6. In the drawing ((B) of FIG. 6), the collision-preventing member has a semi-circular shape and is disposed such that the central point of the curved surface corresponds to the shaft center of the barrel tank 11. The mass M separated from the inner wall of the barrel tank 11 moves to the collision-preventing member 30*b* as indicated by an arrow in the drawing. Then, the mass collides with the inner surface of the collision-preventing member 60, whereby the kinetic energy decreases. Thereafter, the mass M moves downward along the inner surface to further decrease the kinetic energy thereof and then is dropped onto the inner wall of the barrel tank 11. When the mass M collides with the inner wall of the barrel tank 11, the kinetic energy markedly decreases and it is thus possible to occurrence of damage in the workpieces.

REFERENCE SIGNS LIST

1 . . . Centrifugal barrel polishing machine, 2 . . . Housing, 3 . . . Sliding door, 10 . . . Polishing unit, 11 . . . (11*a*, 11*b*, 11*c*, 11*d*) Barrel tank, 12 . . . Barrel tank case, 13 . . . (13*a*, 13*b*, 13*c*, 13*d*) Rotation shaft, 14 . . . Turret (rotary disc), 15 . . . Revolution shaft, 20 . . . Rotating mechanism, 21 . . . Drive motor, 22 . . . Driving pulley, 23 . . . Revolution pulley, 24 . . . Driving belt, 25A, 25B . . . Driven pulley, 26*a*, 26*b*, 26*c*, 26*d* . . . Rotation pulley, 27A, 27B . . . Driven belt, 28A, 28B . . . Tightening pulley, 30 . . . Tilting mechanism, 31 . . . Base, 31*a* . . . Tiltable base, 31*b* . . . Tilting member, 31*c* . . . Pivot shaft, 31*d* . . . Rotation shaft bearing, 32 . . . Tilt trestle, 32*a* . . . Pivot shaft bearing, 33 . . . Cylinder, 33*a* . . . Piston, 40 . . . Control mechanism, 41 . . . Input unit, 42 . . . Control unit, 50 . . . Preliminary rotation system, 51 . . . Preliminary drive motor, 52 . . . Preliminary driving pulley, 53 . . . Preliminary rotation pulley, 54 . . . Preliminary driving belt, 55 . . . Clutch mechanism, 60 . . . Collision-preventing member, C1, C2, C3 . . . Centrifugal force, M . . . Mass, T1, T2, T3, T4, T5 . . . Time.

The invention claimed is:

1. A centrifugal barrel polishing machine that polishes workpieces by rotating and revolving a barrel tank containing a mass including the workpieces and a polishing medium, comprising:

a disc-like turret configured to turn about a revolution shaft;

a plurality of barrel tanks each installed in the turret via a rotation shaft and configured to turn about the rotation shaft;

a rotating mechanism configured to turn the turret and the barrel tanks;

a tilting mechanism configured to tilt the revolution shaft of the turret with respect to a horizontal plane and to tilt each rotation shaft with respect to the horizontal planes;

rotation speed adjusting means for controlling a rotation speed of the rotation and revolution of the barrel tanks; and a control unit configured to perform;

a first acceleration step of adjusting the speed of the rotation and revolution of the barrel tanks using the rotation speed adjusting means such that the centrifugal force applied to the mass reaches a first centrifugal force, which is set as a centrifugal force immediately before the mass is separated from inner walls of each barrel tank with its own weight, within a first period of time; and a second acceleration step of adjusting the speed of the rotation and revolution of the barrel tanks using the rotation speed adjusting means such that the centrifugal force applied to the mass reaches a second centrifugal force, which is set as a centrifugal force for centrifugally bringing the mass into contact with the inner walls of each barrel tank, within a second period of time after the first acceleration step.

2. The centrifugal barrel polishing machine according to claim 1, wherein the tilting mechanism disposes each rotation shaft to be tilted in a range of 30° to 70° with respect to the horizontal plane.

3. The centrifugal barrel polishing machine according to claim 1, further comprising a plurality of barrel tank cases to which the barrel tanks are detachably respectively fixed, wherein the rotation shafts are respectively installed on one of the ends of the barrel tank cases, and wherein each rotation shaft is rotatably fixed to the turret.

4. The centrifugal barrel polishing machine according to claim 1, further comprising tilt angle adjusting means for freely adjusting an angle at which the rotation shafts are tilted with respect to the horizontal plane.

5. The centrifugal barrel polishing machine according to claim 1, further comprising a preliminary rotation mechanism configured to only rotate each barrel tank.

6. A barrel polishing method using the centrifugal polishing machine according to claim 1, comprising: a step of setting the first centrifugal force in a range of 0.3 G to 1.0 G and setting the second centrifugal force in a range from 1.5 G to 6.0 G.

7. A barrel polishing method using the centrifugal polishing machine according to claim 5, comprising:

a preliminary polishing step of rounding angular portions of corners and edges of the workpieces by rotating each barrel tank through operation of the preliminary rotation mechanism; and a step of polishing the workpieces by rotating and revolving the barrel tanks after the preliminary polishing step.

8. The barrel polishing method according to claim 7, wherein the workpieces are formed of a hard brittle material.

9. A centrifugal barrel polishing machine that polishes workpieces by rotating and revolving a barrel tank containing a mass including, the workpieces and a polishing medium comprising:

a disc-like turret configured to turn about a revolution shaft;

a plurality of barrel tanks each installed in the turret via a rotation shaft and configured to turn about the rotation shaft;

a rotating mechanism configured to turn the turret and the barrel tanks; and a tilting mechanism configured to tilt the revolution shaft of the turret with respect to a horizontal plane and to tilt each rotation shaft with respect to the horizontal plane, wherein the tilting mechanism includes:

a base to which the turret is fixed to be rotatable about the revolution shaft;

a tilt trestle configured to tiltably fix the base; and a turning mechanism connected to the base and configured to freely tilt the base.

10. The centrifugal barrel polishing machine according, to claim 9, wherein the turning mechanism is a cylinder configured to freely tilt the base through extension and contraction of a piston.

11. A barrel polishing method using the centrifugal polishing machine according to claim 9, comprising:

a step of rotating and revolving the barrel tanks; and a step of polishing the workpieces through the rotation and revolution of the barrel tanks, wherein the step of rotating and revolving the barrel tanks includes a step of continuously changing the angle formed by each rotation shaft and the horizontal plane.

12. The centrifugal barrel polishing machine according to claim 9, wherein the tilting mechanism disposes the rotation shafts to be tilted in a range of 30° to 70° with respect to the horizontal plane.

13. The centrifugal barrel polishing machine according to claim 9, further comprising a plurality of barrel tank cases to which the barrel tanks are detachably respectively fixed, wherein the rotation shafts are respectively installed on one of the ends of the barrel tank cases, and wherein each rotation shaft is rotatably fixed to the turret.

14. The centrifugal barrel polishing machine according to claim 9, further comprising tilt angle adjusting means for freely adjusting an angle at which the rotation shafts are tilted with, respect to the horizontal plane.

15. The centrifugal barrel polishing machine according to claim 9, further comprising further comprising rotation speed adjusting means for controlling a rotation speed of the rotation and revolution of the barrel tanks.

16. The centrifugal barrel polishing machine according to claim 9, further comprising a preliminary rotation mechanism configured to only rotate each barrel tank.

* * * * *